United States Patent [19]

Buffon et al.

[11] 4,417,461

[45] Nov. 29, 1983

[54] DEVICE FOR MANUFACTURING, BY EXTRUSION, A PIECE HAVING A RECESSED PORTION IN ITS PERIPHERAL SURFACE

[75] Inventors: Jean Buffon, Corbeil; Edouard Trome, Aulnay-sous-Bois, both of France

[73] Assignee: Societe anonyme dite: Ulmic France, Rungis, France

[21] Appl. No.: 227,360

[22] Filed: Jan. 22, 1981

[30] Foreign Application Priority Data

Jan. 21, 1980 [FR] France ..... 80 01235

[51] Int. Cl.[3] ..... B21D 45/00

[52] U.S. Cl. ..... 72/345; 72/354; 72/361; 72/427

[58] Field of Search ..... 72/345, 352, 353, 354, 72/357, 361, 427

[56] References Cited

U.S. PATENT DOCUMENTS

| | | | |
|---|---|---|---|
| 1,619,495 | 3/1927 | Wilcox | 72/357 X |
| 2,979,004 | 4/1961 | Kenville | 72/345 |
| 3,188,849 | 6/1965 | Wisebaker et al. | 72/357 X |

*Primary Examiner*—Leon Gilden

*Attorney, Agent, or Firm*—McAulay, Fields, Fisher, Goldstein & Nissen

[57] ABSTRACT

A device for manufacturing, by extrusion, a piece having a recessed portion in its lateral surface, and, on one side, a head and, on the opposite side, a tail, which device comprises a fixed die holder containing a die, a punch borne by a mobile support and structure for axially displacing the punch to engage it in the die and to disengage it therefrom together with means for ejecting the extruded piece. The device further comprises, in front of the fixed die holder, a coaxial mobile die holder composed of two parts, forming clamp. A spring and cooperating cams are provided for opening and closing the mobile die holder-forming clamp and an actuator is provided for displacing the mobile die holder in translation parallel to the axis of the punch and of the die. After the actual extrusion operation, the mobile die holder-forming clamp draws on the head of the extruded piece so as partially or totally to disengage its tail from the die, then the mobile die holder is opened so as to release the piece and allow ejection thereof.

17 Claims, 6 Drawing Figures

14
16a
16
18
22
18a
26
24
28

15
17
23
19
19b
19a
27
25
13
16a
17a
18b
38
38a
38b
38c
38d
36a
36

DEVICE FOR MANUFACTURING, BY EXTRUSION, A PIECE HAVING A RECESSED PORTION IN ITS PERIPHERAL SURFACE

BACKGROUND OF THE INVENTION

The present invention relates to a process and a device for manufacturing, by extrusion, a piece having a recessed portion in its peripheral surface.

Extrusion is advantageously used in the mass production of pieces, since it offers numerous advantages, including the obtaining of pieces having an excellent finish, a saving of material since there is no loss, and the manufacture in one operation of pieces of any cross section. The latter advantage is particularly interesting in the case of pieces of very small dimensions obtained by micro-extrusion, since it is not possible to obtain a polygonal cross section by cutting-off. Small pieces made of copper can, in fact, not be milled.

Although the process of extrusion presents many advantages, it has, however, not heretofore been useful for manufacturing pieces having recessed portions in their peripheral surface, for example transverse grooves. In fact, in order to be able to eject an extruded piece, its cross section must always be able to vary in the same direction, to allow it to leave the die by pushing by an ejector. Another limitation to the application of the extrusion process is due to the fact that, in the case of small-dimensioned pieces obtained by micro-extrusion, it is not possible to proceed with conventional ejection in forward extrusion by pushing on the rod of the piece with an ejector. In fact, as the piece is of reduced dimensions, the same applies to the ejector and such as ejector would buckle under the force to be effected.

SUMMARY OF THE INVENTION

It is an object of the present invention to remedy these drawbacks, by providing a process and a device for obtaining, by extrusion, by very simple means, small pieces having recessed portions.

To this end, the process of manufacturing, by extrusion, a piece having a recessed portion in its lateral surface, and on one side, a head and, on the opposite side, a tail, in which process a punch is engaged in a tubular blank and the blank is pushed by the punch in the die of a fixed die holder, is characterised in that the punch and the blank are engaged through a mobile die holder placed in front of the fixed die holder then, after the actual extrusion operation, the mobile die holder forming clamp draws on the head of the extruded piece so as partially or totally to disengage its tail from the die, whereupon the mobile die holder is opened so as to release the piece and allow ejection thereof.

It is also an object of the invention to provide a device for carrying out the above-mentioned process, comprising a fixed die holder containing a die, a punch borne by a mobile support, means for axially displacing the punch to engage it in the die and to disengage it therefrom, and means for ejecting the extruded piece, wherein said device further comprises, in front of the fixed die holder, a coaxial mobile die holder composed of two parts, forming clamp, means for opening and closing said mobile die holder forming clamp and means for displacing the mobile die holder in translation parallel to the axis of the punch and of the die.

The process and the device according to the invention offer the advantage that flanged pieces may be made by micro-extrusion or extrusion, which pieces could not be obtained previously due to the difficulties in ejecting them. Small pieces of any cross section and having a recessed portion forming a groove, may thus easily be manufactured at a high production rate. Furthermore, the pieces obtained have an excellent surface quality and do not require an additional finishing operation.

BRIEF DESCRIPTION OF THE DRAWINGS

The invention will be more readily understood on reading the following description with reference to the accompanying drawings, in which:

FIG. 4 is a view in partial horizontal section along line IV—IV of FIG. 1, the mobile die holder being closed.

FIG. 5 is a diagram, on a larger scale, illustrating the drive of the extruded piece by the mobile die holder, before the latter opens.

FIG. 6 is a view in horizontal section, similar to that of FIG. 4, showing the mobile die holder open.

DESCRIPTION OF THE PREFERRED EMBODIMENT

Figure 1:
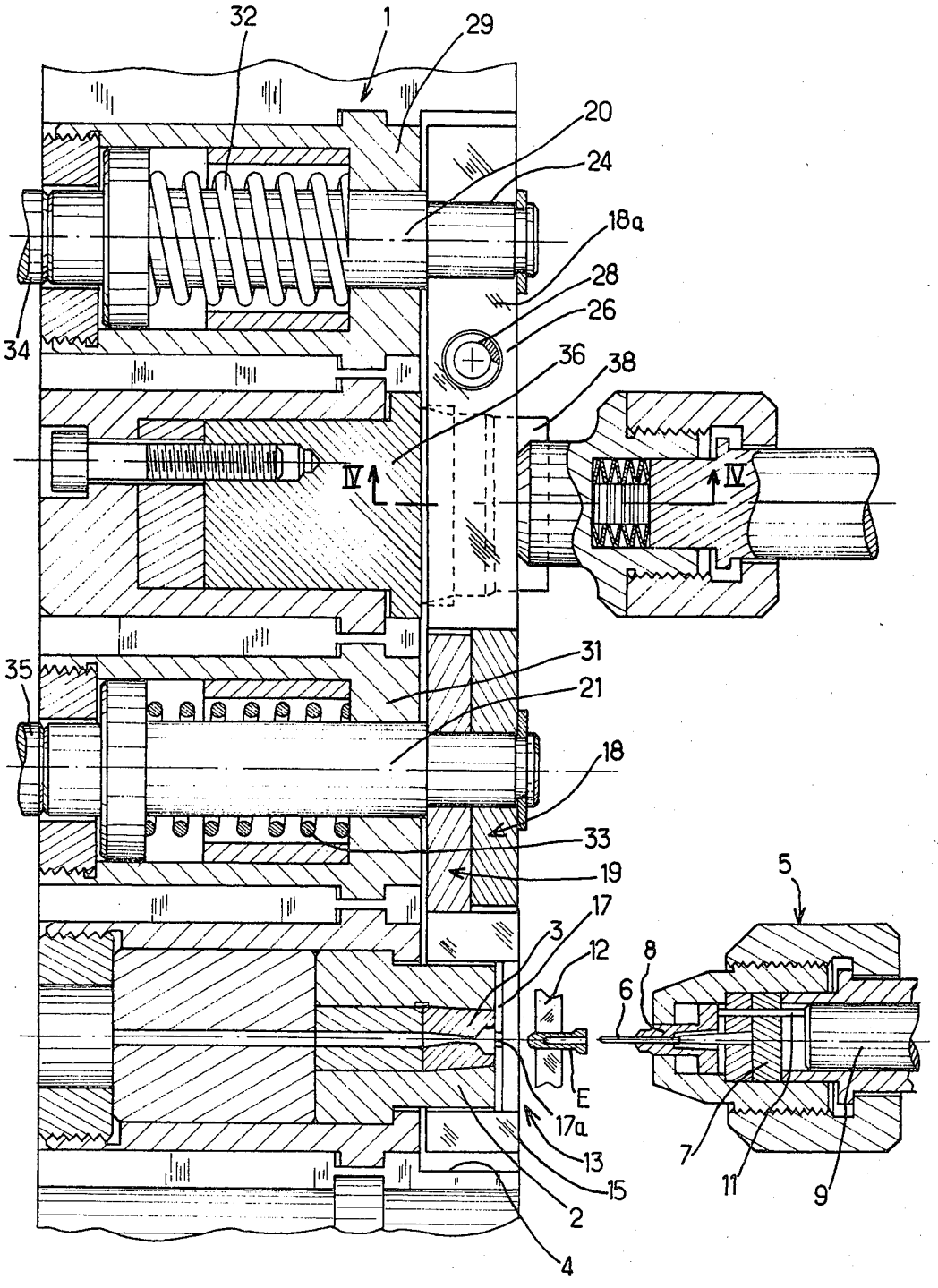
FIG. 1 is a view in vertical section of an extrusion press carrying out the process according to the invention.

Referring now to the drawings, FIG. 1 shows a tool-holder 1 of an extrusion press. This tool-holder 1 comprises, in its lower part, a fixed die-holder 2 inside which is mounted a die 3 of horizontal axis. The die-holder 2 containing the die 3 projects with respect to the bottom end of a recess 4 which extends vertically and which is arranged in the straight front face of the tool-holder 1. Opposite the die 3, a support 5 of a punch 6 fast with a punch-holder 7 fixedly mounted inside the support 5, may move horizontally. On the punch 6 is slidably mounted an ejector 8 whose movement of axial slide may be provoked by a thrust disc 9 acting on a thrust column 11 disposed between the thrust disc 9 and the ejector 8.

The extrusion operation which must be carried out by means of the press illustrated in FIG. 1 is effected on a tubular blank E which is brought in front of the punch 6, in the axis thereof, by a transfer device 12.

Figures 2, 3:
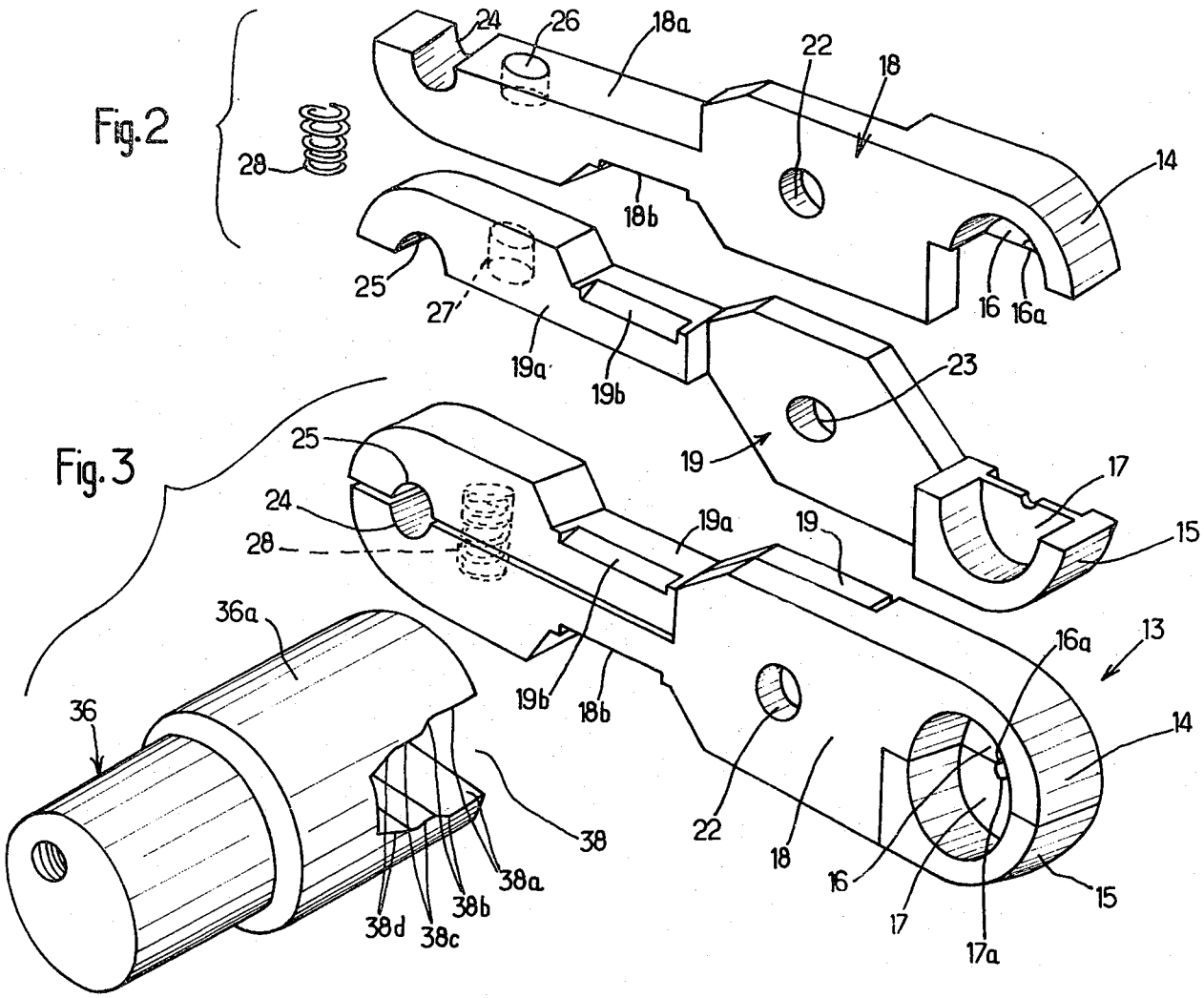
FIG. 2 is an exploded view in perspective of the two arms of the clamp forming the mobile die holder.
FIG. 3 is a view in perspective of the closed mobile die holder and of the clamp chuck ensuring closure thereof.

The extrusion press comprises, in addition to the fixed die holder 2, a mobile die-holder generally designated as 13, which is shown in detail in FIGS. 2 and 3. This mobile die holder 13 is constituted by two jaws 14 and 15 of substantially semi-circular cross section. These two jaws 14 and 15 are applied against each other, when the die holder 13 is closed, the joint being made along a diametrical plane. The jaws 14 and 15, respectively bear, inside, respective transverse cheeks 16 and 17 of semi-circular form, having at their central cut-outs **16*a* and 17*a*, likewise semi-circular, which two cut-outs 16*a*, 17*a* form a circular hole when the mobile die-holder 13** is closed, through which hole the tubular blank E is engaged during the extrusion operation.

The transverse cheeks 16, 17 may be integral with the body of the jaws 14 and 15, or constitute independent pieces added to said jaws, this enabling them to be easily changed in case of wear. The semi-circular cheeks 16, 17 define in the jaws 14 and 15, when the mobile die holder 13 is closed, a housing in which the fixed die holder 2 is engaged, as may be seen in FIG. 1.

According to the invention, the jaws 14 and 15 are mounted mobile with respect to each other, so that the mobile die holder 13 can open or close.

According to a non-limiting embodiment shown in FIGS. 2 and 3, the jaws 14 and 15 are provided respectively at the ends of two arms 18 and 19 which are mounted to pivot on one another, about a pivot pin 21 (FIG. 1) passing through opposite holes 22 and 23 made respectively in the arms 18 and 19. In the end parts 18*a* and 19*a* of the arms opposite the jaws 14 and 15, two semi-circular notches 24 and 25 are formed, thus defining a hole through which is engaged the end of a horizontal pin 20 (FIG. 1).

The two arms 18 and 19 are mounted in the manner of a pair of scissors. In other words, the end part 18*a* of the arm 18 which extends opposite the jaw 14 is located, in FIGS. 2 and 3, beneath the corresponding end part 19*a* of the arm extending opposite the jaw 15, whilst the jaw 14 is itself above the jaw 15. These two end parts 18*a* and 19*a* are pierced with blind holes 26 and 27 respectively, opening in the faces by which the end parts 18*a* and 19*a* abut on each other, and a compression spring 28 is housed in these blind holes 26 and 27. This spring 28 consequently tends to space the end parts 18*a*, 19*a* and, in the same way, the jaws 14 and 15, away from one another.

The assembly of the two arms 18 and 19, constituting a sort of clamp, is mounted to move in horizontal translation on the tool-holder 1. In rest position, in which the mobile die holder 13 is closed, this assembly 18, 19 is retracted inside the recess 4 provided in the straight vertical face of to tool holder 1, as shown in FIG. 1. The two pins 20 and 21 are mounted for horizontal slide in respective bearings 29 and 31 and they are urged towards the left in FIG. 1 by springs 32 and 33. These pins 20 and 21 are thus permeanently maintained applied against respective thrust discs 34 and 35 which are actuated by cams forming part of the general control mechanism of the machine.

The clamp constituted by the two arms 18 and 19 may be closed by the action of a clamp chuck 36 which is fixed in the tool-holder 1 by means of screws 37. This clamp chuck 36, which extends horizontally, comprises a head 36*a* which projects in the recess 4.

This head 36*a* is cut out so as to form a substantially U-shaped diametrical opening 38. More particularly, this opening, of which the width decreases from its inlet to its bottom end, is defined by two parallel, symmetrical flat portions 38*a* which are then joined, by inwardly inclined ramps 38*b*, to two other flat portions 38*c* of which the distance separating them is shorter than that between the two flat portions 38*a*, the two flat portions 38*c* being in turn joined to the bottom end of the opening by two inwardly inclined ramps 38*d* of the same inclination as the ramps 38*b*. The axial section of the head 38*a* of the clamp chuck 36 is clearly shown in FIGS. 4 and 6.

In position of closure of the clamp formed by the arms 18 and 19 (FIGS. 1 and 4), the two end parts 18*a*, 19*a* of the arms 18 and 19 are engaged at the bottom end of the opening 38. FIG. 4 clearly shows that, in this position, the upper face of the upper end part 19*a* and the lower face of the lower end part 18*a* are respectively in abutment on the two flat portions 38*c* of which the distance therebetween corresponds to the sum of the thicknesses of the two end parts 18*a* and 19*a*. These two end parts present, on the side facing the bottom end of the opening 38, respective chamfers 18*b*, 19*b* of which the inclination corresponds to that of ramps 38*b* and 38*d*. In position of closure, the chamfers 18*b*, 19*b* are therefore in abutment against the ramps 38*d*. The clamp formed by the arms 18, 19 is engaged in the opening 38 of the clamp chuck 36 under the action of a push member 39 moved by the general control mechanism of the machine. The functioning of the extrusion press which has just been described will now be described in the course of a complete cycle of extrusion of a piece.

At the beginning of the cycle of operation, the mobile die holder formed by the two jaws 14, 15 and the two transverse cheeks 16, 17 is closed and it covers the fixed die holder 2 containing the die 3, as shown in FIG. 1. The axis of the die 3 is opposite the axis of hole 16*a*, 17*a* of the mobile die holder, this axis itself being aligned with that of the tubular blank E brought into position by the transfer device 12 and the punch 6.

The first step of the process, which constitutes the actual extrusion operation consists in displacing the block with the nut 5 towards the left in FIG. 1. During this movement, the punch 6 engages in the bore of the blank E and pushes the latter towards the left through the hole 16*a*, 17*a* of the mobile die holder then in the die 3. This die 3 presents an inlet opening with a diameter greater than that of the hole 16*a*, 17*a*, as may be seen more readily in FIG. 5. The engagement of the punch inside the tubular blank E provokes creeping of the matter composing this blank which then takes the form of the section of the die 3, as may be seen in FIG. 5. An extruded pice 41 is then obtained which comprises a tail 41*a* engaged in the die 3, a head 41*b* located on the outside of the cheeks 16, 17, a flange 41*c* formed by creeping in the die and located on the inside of the cheeks 16, 17 and a groove 41*d* defined between the head 41*b* and the flange 41, this groove taking the form of the contour of the central hole 16*a*, 17*a*.

The following operation consists in a movement of translation towards the right of the mobile clamp formed by the two arms 18 and 19, as well as of the support 5 of the punch 6 and of the push member 39. To this end, the cams of the general control mechanism of the machine act on the thrust discs 34, 35 to cause them to slide towards the right in FIG. 1, this bringing about a simultaneous translation in the same direction of pins 20 and 21 against the return springs 32 and 33 which are compressed in their housings. In the first part of the movement, the clamp formed by the arms 18 and 19 remains closed. In fact, FIG. 4 shows that the two end parts 18*a* and 19*a* are held applied against each other by the flat portions 38*c* of the clamp chuck 36. When the end parts 18*a*, 19*a* arrive at the beginning of the inclined ramps 38*b*, they begin to move apart from each other, sliding on these ramps, under the action of the compression spring 28 provoking the opening of the clamp. This combined movement of opening of the clamp and of translation is continued until the end parts 18*a*, 19*a* come into contact with the flat portions 38*a* which are the most spaced apart. These flat portions 38*a* then hold the clamp in open position. In the course of this movement, similar movements are made on the other side of the pivot pin 21. In other words, in the first part of the stroke (slide of the end parts 18*a*, 19*a* on the flat portions 38*c*), the two cheeks 16, 17 remain applied against each other, in other words the mobile die holder 13 remains closed. This mobile die-holder then drives the extruded piece 41 towards the right, as indicated in FIG. 5, the cheeks 16 and 17 of the mobile die holder exerting their effort on the opened head of this piece. This movement makes it possible to disengage the extruded tail 41*a* partially or totally from the die 3.

Upon opening of the clamp formed by the arms 18 and 19 (slide of the end parts 18*a*, 19*a* on the ramps 38*b* up to the flat portions 38*a*), the two cheeks 16, 17 then move apart from each other (as indicated by the arrows in FIG. 5), so that the extruded piece $E_1$ is released and remains on the punch 6. The punch 6 then continues to be driven towards the right by its support 5 until the extruded piece 41 is totally disengaged from the die 3. It then suffices to slide the ejector 8 towards the left on the punch 6 to provoke the ejection of the extruded piece. During the ejection operation, the general control mechanism of the machine returns the various mobile elements in their starting positions. The clamps are returned by the return springs. The push member 39 at the beginning of the cycle tightens the clamps.

Although in the embodiment which has been described hereinabove, the mobile due holder constituted by the two jaws 14 and 15 is formed at the ends of two arms 18, 19 pivoting about a pin, a die holder with two jaws mobile in translation may also be made, without departing from the scope of the invention, these jaws being fast with slide blocks mobile in appropriate guides so as to apply the two jaws against each other, when the die holder is closed or, on the contrary, to separate them from each other to release the extruded piece.

The jaws may form part of an independent assembly which may be mounted on different types of machines. The principle applies both to a clamp movement, of the scissors type, and to perpendicular working, i.e. a small press.

The hole which is defined at the centre of the mobile die holder 13 by the notches 16*a* and 17*a* of the respective transverse cheeks 16, 17 may be circular, as in the example above-described, or of polygonal cross section or of any other form, depending on the shape which it is desired to obtain for the groove 41*d* of the extruded piece 41. The shape of this groove is in fact determined by that of the contour of the hole 16*a*, 17*a*, through which the blank E borne by the punch 6 is engaged.

As may be seen from the foregoing description, the principle of the device according to the invention is to have a system of opening die holder which is closed during operation and which serves to remove the pieces with outer impressions and, after total or partial ejection, to release them to the punch.

This process may be used for all extruded materials.

It is not limiting as regards the number of uses of this system on the same machine.

What we claim is:

1. A device for extruding a piece having a recessed portion in its lateral surface, comprising a fixed die holder containing a die, a punch borne by a mobile support, means for axially displacing said punch to engage said punch in said die and disengage it therefrom, means for ejecting an extruded piece, and in front of said fixed die holder, a coaxial mobile due holder, means for opening and closing said mobile die holder, means for displacing said mobile die holder in translation parallel to the axis of said punch and of said die, said mobile die holder having two jaws applied against each other when said mobile die holder is closed, said jaws being provided respectively at the ends of two arms mounted to pivot on each other about a first pin passing through opposite holes made in said arms, whereby said mobile die holder forms a clamp.

2. The device of claim 1, wherein it comprises a spring urging the two arms constituting the mobile die holder in the direction of opening, and spacing apart the jaws.

3. The device of claim 2, wherein the spring is a compression spring housed in blind holes made in end parts of the respective arms which are located opposite the jaws with respect to the pivot pin.

4. The device of claim 3, wherein the end parts of the arms opposite the jaws respectively present semi-circular notches of any other form, applied one on the other when the mobile die holder is closed and thus defining a hole through which is engaged the end of a second pin parallel to the first pivot pin for the arms.

5. The device of claim 4, wherein the first and second pins, parallel to each other, are mounted to slide in respective bearings and are urged by springs towards respective thrust discs actuated by cams.

6. The device of claim 5, wherein it comprises a fixed clamp chuck comprising a head cut out so as to form a substantially U-shaped diametrical opening in which are engaged the two end parts of the arms, opposite the jaws, the width of the opening being smaller near its bottom end than near its inlet so that the mobile die holder is closed when the two end parts are in the bottom end of the opening and, on the contrary, open when these two end parts are close to the inlet of the opening.

7. The device of claim 6, wherein the opening of the head of the clamp chuck is defined, at its inlet, by two first parallel and symmetrical flat portions which are joined, by first inwardly inclined ramps, to two second flat portions of which the distance separating them is shorter than that between the two first flat portions, the two second flat portions being in turn joined to the bottom end of the opening by two second inwardly inclined ramps of the same inclination as the first ramps, the two end parts of the arms presenting, on the side facing the bottom end of the opening, respective chamfers whose inclination corresponds to that of the ramps, the distance between the two second flat portions being equal to the sum of the thicknesses of the end parts so that the mobile die holder is closed when the two end parts are located between the two second flat portions.

8. The device of claim 7, wherein the clamp formed by the arms is pushed in the opening of the clamp chuck under the action of a push member mobile in translation.

9. The device of claim 2, wherein the two parts constituting the mobile die holder form two jaws mobile in translation.

10. The device of claim 2, wherein the jaws comprise respective transverse cheeks presenting, on their edges coming into contact, cut-outs forming a hole when the mobile die holder is closed, through which is engaged the tubular blank borne by the punch.

11. The device of claim 2, wherein the jaws comprise respective transverse cheeks presenting, on their edges coming into contact, cut-outs forming a hole when the mobile die holder is closed, through which is engaged the tubular blank borne by the punch.

12. The device of claim 3, wherein the jaws comprise respective transverse cheeks presenting, on their edges coming into contact, cut-outs forming a hole when the mobile die holder is closed, through which is engaged the tubular blank borne by the punch.

13. The device of claim 4, wherein the jaws comprise respective transverse cheeks presenting, on their edges coming into contact, cut-outs forming a hole when the mobile die holder is closed, through which is engaged the tubular blank borne by the punch.

14. The device of claim 5, wherein the jaws comprise respective transverse cheeks presenting, on their edges coming into contact, cut-outs forming a hole when the mobile die holder is closed, through which is engaged the tubular blank borne by the punch.

15. The device of claim 6, wherein the jaws comprise respective transverse cheeks presenting, on their edges coming into contact, cut-outs forming a hole when the mobile die holder is closed, through which is engaged the tubular blank borne by the punch.

16. The device of claim 7, wherein the jaws comprise respective transverse cheeks presenting, on their edges coming into contact, cut-outs forming a hole when the mobile die holder is closed, through which is engaged the tubular blank borne by the punch.

17. The device of claim 8, wherein the jaws comprise respective transverse cheeks presenting, on their edges coming into contact, cut-outs forming a hole when the mobile die holder is closed, through which is engaged the tubular blank borne by the punch.

* * * * *